US009295135B2

(12) United States Patent
Kim

(10) Patent No.: US 9,295,135 B2
(45) Date of Patent: Mar. 22, 2016

(54) POWER SUPPLY HAVING A PLURALITY OF LIGHT EMISSION UNITS

(75) Inventor: Sung Eun Kim, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 223 days.

(21) Appl. No.: 13/976,610

(22) PCT Filed: Oct. 11, 2011

(86) PCT No.: PCT/KR2011/007542

§ 371 (c)(1),
(2), (4) Date: Jun. 28, 2013

(87) PCT Pub. No.: WO2012/091259

PCT Pub. Date: Jul. 5, 2012

(65) Prior Publication Data

US 2013/0271020 A1 Oct. 17, 2013

(30) Foreign Application Priority Data

Dec. 27, 2010 (KR) ..... 10-2010-0136076

(51) Int. Cl.

| | |
|---|---|
| ***H05B 37/00*** | (2006.01) |
| ***H05B 39/00*** | (2006.01) |
| ***H05B 37/02*** | (2006.01) |
| ***H05B 33/08*** | (2006.01) |

(52) U.S. Cl.

CPC ..... *H05B 37/02* (2013.01); *H05B 33/0815* (2013.01)

(58) Field of Classification Search

CPC ..... H05B 33/081; H05B 37/02451; Y02B 20/346; G06F 13/42

See application file for complete search history.

(56) References Cited

U.S. PATENT DOCUMENTS

| | | | | |
|---|---|---|---|---|
| 8,653,738 | B2 * | 2/2014 | He et al. | 315/192 |
| 8,963,438 | B2 * | 2/2015 | McMahon | 315/224 |
| 2008/0211987 | A1 | 9/2008 | Kim et al. | 349/61 |
| 2010/0019694 | A1 | 1/2010 | Chen et al. | 315/297 |
| 2010/0208452 | A1 | 8/2010 | Park | 362/97.1 |
| 2012/0007521 | A1 | 1/2012 | Otake et al. | 315/294 |

FOREIGN PATENT DOCUMENTS

| | | | |
|---|---|---|---|
| CN | 201044524 | Y | 4/2008 |
| CN | 101316468 | A | 12/2008 |

(Continued)

OTHER PUBLICATIONS

Chinese Office Action dated Sep. 22, 2014 issued in Application No. 201180066490.X (Original Office Action and English Translation).

(Continued)

*Primary Examiner* — Hai L Nguyen

(74) *Attorney, Agent, or Firm* — Ked & Associates, LLP

(57) ABSTRACT

A power supply is provided. The power supply includes a plurality of light emission units, a power source, a plurality of boards, a plurality of board resistors, and a feedback control unit. The light emission units are connected in parallel, and include a plurality of LEDs. The power source supplies a DC voltage to the light emission units. The boards have at least one light emission mounted thereon. The board resistors are disposed in each of the boards, and electrically connected to each other. The feedback control unit varies a current supplied from the power source, according to sum of the board resistors which are changed according to the number of connected boards.

10 Claims, 2 Drawing Sheets

(56) References Cited

FOREIGN PATENT DOCUMENTS

| | | | |
|---|---|---|---|
| CN | 101636028 | A | 1/2010 |
| CN | 10778508 | A | 7/2010 |
| JP | 2004-158840 | A | 6/2004 |
| JP | 2008-130295 | A | 6/2008 |
| JP | 2008-300208 | A | 12/2008 |
| JP | 2009-210484 | A | 9/2009 |
| KR | 10-0786096 | B1 | 12/2007 |
| KR | 10-2010-0120786 | A | 11/2010 |
| TW | M379173 | U1 | 4/2010 |

OTHER PUBLICATIONS

Chinese Office Action dated May 15, 2014, issued in Application No. 201180066490.X (with English translation).

International Search Report dated Apr. 4, 2012 issued in Application No. PCT/KR2011/007542.

* cited by examiner

POWER SUPPLY HAVING A PLURALITY OF LIGHT EMISSION UNITS

TECHNICAL FIELD

The present disclosure relates to a power supply.

BACKGROUND ART

Generally, Liquid Crystal Displays (LCDs) include two display substrates where an electric field applying electrode is displayed, and a liquid crystal layer that has dielectric anisotropy and is disposed between the two substrates. LCDs apply a voltage to an electric field applying electrode to generate an electric field in a liquid crystal layer, change the voltage to adjust intensity of the electric field, and thus adjust a transmittance of light passing through the liquid crystal layer, thereby displaying a desired image.

Since LCDs cannot self emit light, the LCDs require a separate light source called a backlight, and the light source is being replaced by Light Emitting Diodes (LEDs).

Since LEDs are semiconductor devices, LEDs have long service life, fast lighting speed, low consumption power, and excellent color reproductivity. Moreover, LEDs are robust to impact, and facilitate the miniaturizing and thinning of LEDs. Therefore, a backlight using LEDs are being mounted on medium and large LCDs such as computer monitors and televisions (TVs), in addition to small LCDs mounted on mobile phones, etc.

DISCLOSURE OF INVENTION

Technical Problem

Embodiments provide a power supply with a new current regulation circuit.

Embodiments also provide a power supply which automatically senses the change in the number of LEDs and varies an output current in correspondence with the change in the number of LEDs.

Embodiments also provide a power supply which supplies a current to LEDs of each board in a constant current scheme, according to the change in the number of boards including LEDs.

Solution to Problem

In one embodiment, a power supply includes: a plurality of light emission units connected in parallel, and comprising a plurality of Light Emitting Diodes (LEDs); a power source supplying a Direct Current (DC) voltage to the light emission units; a plurality of boards having at least one light emission mounted thereon; a plurality of board resistors disposed in each of the boards, and electrically connected to each other; and a feedback control unit varying a current supplied from the power source, according to sum of the board resistors which are changed according to the number of connected boards.

Advantageous Effects of Invention

According to embodiments, a light emission unit including LEDs and a lighting system such as a light unit including the light emission unit can be improved in reliability.

According to embodiments, a current can be supplied in a constant current scheme, according to the change in the number of light emission units including LEDs or the number of boards.

According to embodiments, the power supply and a lighting system such as a backlight unit including the power supply can be improved in reliability.

Mode For The Invention

Hereinafter, embodiments of the present disclosure will be described below in more detail with reference to the accompanying drawings.

Figure 1:
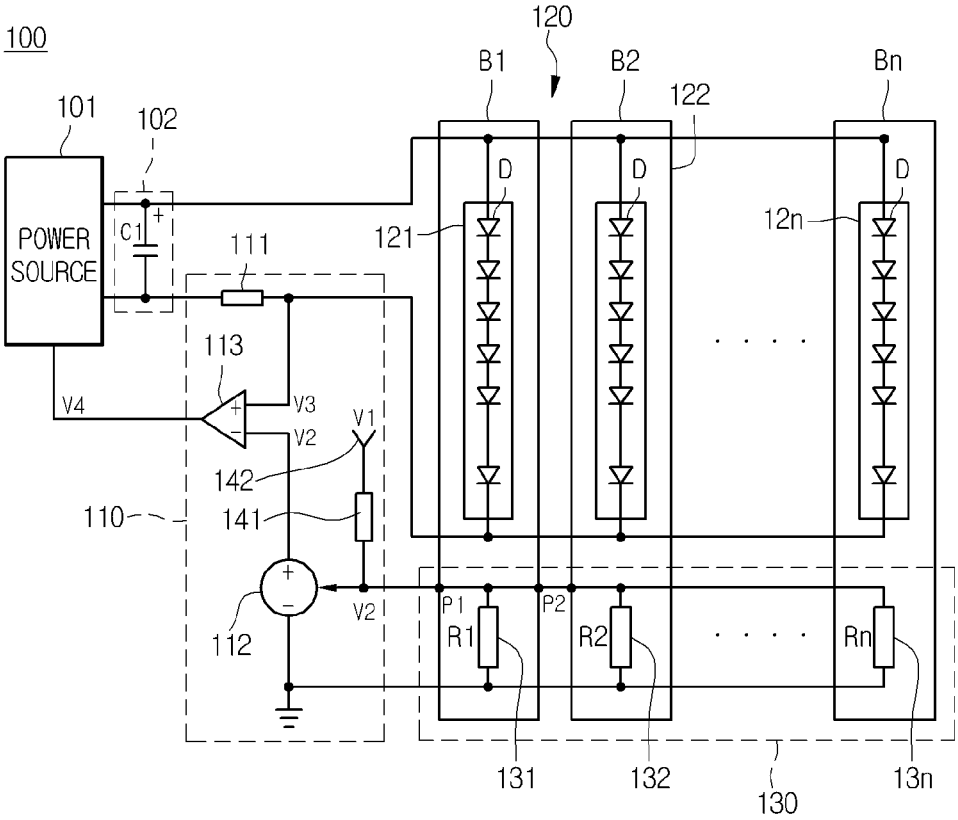
FIG. 1 is a circuit diagram illustrating a power supply according to an embodiment.

Referring to FIG. 1, a power supply according to an embodiment includes a power source 101, a light emission module 120 including a plurality of boards B1 to Bn, and a feedback control unit 110.

The power source 101 may supply an Alternating Current voltage, for example, include a switched-mode power supply (SMPS). The power supply includes a filter 102 that is connected to an output terminal of the power source 101 in parallel. The filter 102 includes a capacitor C1, and removes a ripple included in a Direct Current (DC) voltage.

The light emission module 120 includes the boards B1 to Bn, which may be electrically connected to each other. The boards B1 to Bn may be physically separated from each other, and an interval between the boards B1 to Bn may be constant. However, the embodiment is not limited thereto. Each of the boards B1 to Bn may be a flexible substrate, a rigid substrate, or a metal core Printed Circuit Board (PCB), a material of which may be resin or ceramic, but the embodiment is not limited thereto.

Each of the boards B1 to Bn may include a plurality of light emission units 121 to 12*n* including LEDs, and a load detector 130 including a plurality of board resistors R1 to Rn that are electrically separated from the light emission units 121 to 12*n*.

At least one of the light emission units 121 to 12*n* may be disposed on each of the boards B1 to Bn. In each of the light emission units 121 to 12*n*, a plurality of LEDs D are connected in series. As another example, when a plurality of light emission units are disposed on each of the boards B1 to Bn, the light emission units in each board may be connected to each other in parallel.

Each of the LEDs D is LED emits light of a visible light band such as blue, red, green, and white, but the embodiment is not limited thereto. The light emission units 121 to 12*n* disposed on each of the boards B1 to Bn are connected to each other in parallel. That is, input terminals of the respective light emission units 121 to 12*n* are connected to a positive polarity terminal of the power source 101 in common, and output terminals of the respective light emission units 121 to 12*n* are connected to a negative polarity terminal of the power source 101 in common.

The number of LEDs D in each of the light emission units 121 to 12*n* may be changed according to a voltage inputted by the power source 101, but the embodiment is not limited thereto.

A plurality of board resistors (R1 to Rn) 131 to 13*n* may be respectively disposed on the boards B1 to Bn, and one board resistor may be disposed on each of the boards B1 to Bn. One board resistor may be disposed in each light emission unit, but the present disclosure is not limited thereto. The load detector 130 may include the board resistors 131 to 13*n* that are connected to each other in parallel, and elements such as diodes other than the board resistors may be further connected thereto. However, the embodiment is not limited thereto.

The board resistors (R1 to Rn) 131 to 13*n* may be respectively disposed at a top or bottom of each of the boards B1 to Bn, and the diodes D disposed in each of the light emission units 121 to 12*n* may be electrically opened.

Each of the board resistors 131 to 13*n* is a setting resistor for sensing whether the boards B1 to Bn, namely, the light emission units 121 to 12*n* are connected. The board resistors 131 to 13*n* may automatically change an input current of each of the light emission units 121 to 12*n* according to an output value of each of the board resistors 131 to 13*n*.

For example, the board resistors 131 to 13*n* may be connected to each other in parallel or in series, but the embodiment is not limited thereto.

The number of light emission units 121 to 12*n* or the number of boards B1 to Bn may be sensed according to the number of board resistors 131 to 13*n*. The power supply may automatically change a current inputted to each of the light emission units 121 to 12*n* according to the increase or decrease in the number of light emission units 121 to 12*n*, thereby allowing a constant current to flow.

Values of the respective board resistors 131 to 13*n* may be set arbitrarily, and set as the same value.

The feedback control unit 110 includes a current regulator 111, a reference potential unit 112, and a comparator 113. The current regulator 111 is connected to output terminals of the respective light emission units 121 to 12*n* in common. The current regulator 111 senses a current, flowing into the output terminal of each of the light emission units 121 to 12*n*, to output a current to the power source 101.

The current regulator 111 includes a resistor, and senses the fine change of a current flowing in the current regulator 111, thereby allowing a constant current to flow in the LEDs D of each of the light emission units 121 to 12*n*.

A reference voltage 142 is inputted to one end of a first resistor 141, and another end of the first resistor 141 is connected to the reference potential unit 112. The reference potential unit 112 outputs a potential V2 that has passed through the first resistor 141. Herein, one end of the first resistor 141 and one end of each of the board resistors 131 to 13*n* are connected to the reference potential unit 112 in parallel.

The other end of each of the board resistors R1 to Rn may be connected to a ground terminal. The first resistor 141 may be configured in another structure, for example, a diamond structure, but the embodiment is not limited thereto.

A potential V2 of the reference potential unit 112 may be a voltage that is obtained through voltage-division with values of the respective board resistors 131 to 13*n* and a value of the first resistor 141. Herein, the value of the first resistor 141 is a fixed resistance value, and since the board resistors 131 to 13*n* are connected in parallel, values of the respective board resistors 131 to 13*n* may decrease or increase when at least one board is added or removed. As the values of the respective board resistors 131 to 13*n* decrease or increase, the potential V2 may increase or decrease.

The comparator 113 compares the potential V2 of the reference potential unit 112 and a potential V3 of an input terminal of the current regulator 111, and an output V4 of the comparator 113 is inputted to the power source 101.

The potential V3 of the input terminal of the current regulator 113 may be inputted to a positive polarity terminal of the comparator 113, and the potential V2 of the reference potential unit 112 may be inputted to a negative polarity terminal of the comparator 113. The comparator 113 compares the potential V2 inputted to the negative polarity terminal thereof and the potential V3 inputted to the positive polarity terminal thereof, and as the potential V2 is changed, the output V4 of the comparator 113 is changed. For example, the output V4 of the comparator 113 increases when the potential V2 decreases, but when the potential V2 increases, the output V4 of the comparator 113 decreases.

The power source 101 regulates a current value of the DC power source according to the output V4 of the comparator 113. As the output V4 of the comparator 113 increases, the power source 101 increases a supplied current, but as the output V4 of the comparator 113 decreases, the power source 101 decreases the supplied current. The power source 101 automatically increases or decreases a current according to the number of connected boards B1 to Bn, thereby allowing a constant current to flow.

Herein, the reference potential unit 112 may detect that a value of each of the board resistors 131 to 13*n* is changed to the level of an individual board resistance value according to the addition or removal of the boards B1 to Bn. Since the output V4 of the comparator 113 is changed according to the change of the individual board resistance value, a current supplied by the power source 101 may be regulated according to the individual board resistance value. Therefore, even if a board is added or removed, a current of a constant range may be regulated to be always supplied.

While a separate control value of the power source 101 is not changed, when a board is added, a lower current is supplied by the number of added boards, but when a board is removed, a higher current is supplied by the number of removed boards. In this case, whenever a board is added or removed, the output of the power source 101 is required to be adjusted, but when the output of the power source 101 is not regulated, a board or an LED is damaged.

According to the embodiment, a current, which is inputted to each of the boards B1 to Bn or each of the light emission units 121 to 12*n* according to the output of the comparator 113 that varies by the value of each of the board resistors 131 to 13*n*, is supplied without change irrespective of the change of a board.

Figure 2:
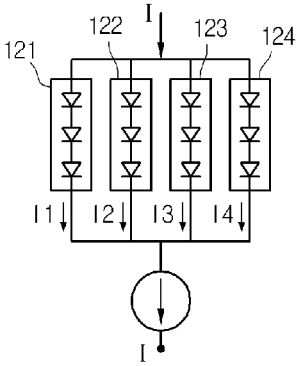
FIG. 2 is a circuit diagram illustrating a constant current control method according to an embodiment.

Referring to FIG. 2, a plurality of LEDs in each of light emission units 121 to 124 are connected in series. An input current I is distributed to the light emission units 121 to 124, and thus, the same level of currents I1 to I4 flow in the light emission units 121 to 124, respectively. For example, when the input current I is about 1000 mA, currents I1 to I4 of about 250 mA flow in the light emission units 121 to 124, respectively.

Furthermore, the currents of the respective light emission units 121 to 124 are summed in output terminals of the respective light emission units 121 to 124, and thus, an output current I of about 1000 mA is sensed. In this way, by setting a reference output current according to a total capacity of the parallel-connected light emission units 121 to 124, the reference output current is controlled as a constant current.

Figure 3:
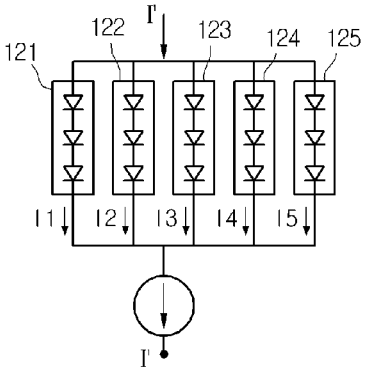
FIG. 3 is a diagram illustrating the change of a current when a board is added to the circuit diagram of FIG. 2.
Figure 4:
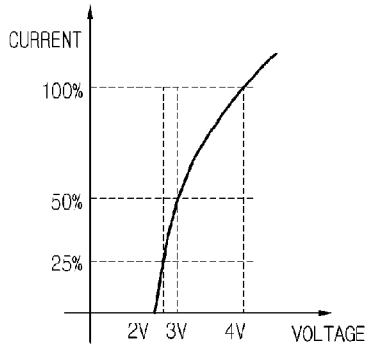
FIG. 4 is a graph showing a relationship between a voltage and a current which flow in a light emission unit according to an embodiment.

Referring to FIG. 3, a fifth light emission unit 125 is additionally connected unlike in FIG. 2, and an input current I' is distributed and supplied to the light emission units 121 to 125. For example, when the input current I' is about 1000 mA, the currents I1 to I5 of about 200 mA flow in the light emission units 121 to 125, respectively. On the contrary, when the number of light emission units in FIG. 3 is less than FIG. 2, a current of each light emission unit increases. Such current change causes light emission to deviate from target light emission, and degrades the reliability of a lighting system such as a backlight unit. Also, when a current flowing in each light emission unit increases, heating of an LED more rises, the deterioration of an LED is accelerated, and service life of an LED is shortened. Therefore, the currents I1 to I5 respectively flowing in the light emission units 121 to 125 are regulated to about 250 mA as in FIG. 2.

As illustrated in FIG. 3, voltage-current characteristics of an LED show that an input current is largely changed even when an input voltage is slightly changed. As a voltage becomes higher, a slope of a change increases sharply, and thus, a constant current is maintained. Accordingly, even when a voltage is changed according to an operating state, a change deviating from target light emission can be prevented.

Figure 5:
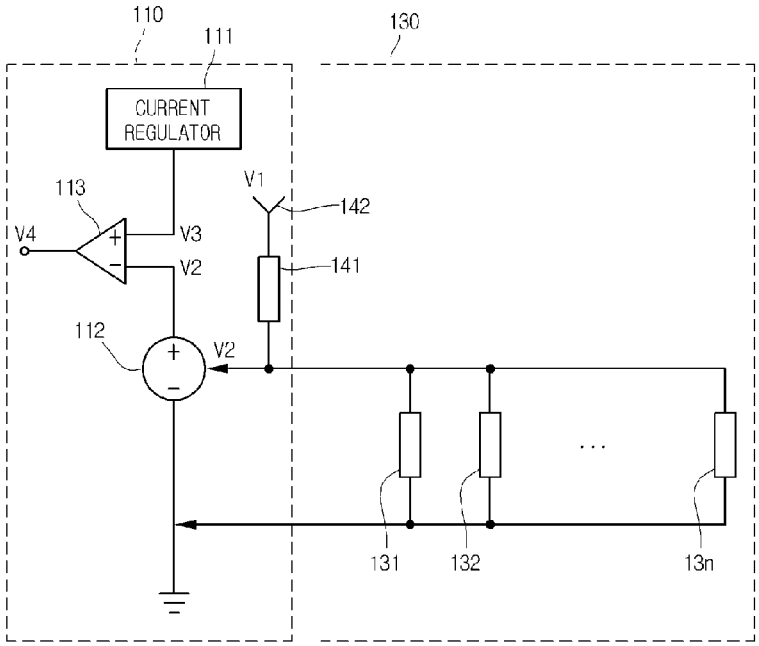
FIG. 5 is a circuit diagram illustrating a power supply for automatically detecting the number of light emission units according to an embodiment.

Referring to FIGS. 1 and 5, the load detector 125 includes the board resistors 131 and 132 disposed in each board, and a parallel resistance value of the board resistors 131 to 13*n* may be outputted.

An output value of the load detector 125 may increase or decrease according to the number of the board resistors 131 to 13*n*. Since the board resistors R1 to Rn are connected to each other in parallel, the output value of each of the board resistors R1 to Rn becomes lower each time a board is added, but whenever a board is removed, the output value of each of the board resistors R1 to Rn becomes higher.

The board resistors R1 to Rn may be connected to each other in parallel or in series, but the embodiment is not limited thereto.

To provide a description as an example, when three boards increase to four boards in number, a current flows in a board resistor that is included in each of the four boards, in which case a lower constant current flows due to constant current characteristic. At this point, by a board resistor disposed in the fourth board, the connection of the fourth board is sensed, and an LED disposed in a light emission unit of the fourth board is sensed. Herein, the same number of LEDs may be set in each light emission unit.

Due to the addition of the fourth board, a value of each of the board resistors further decreases the output of the reference potential unit, and thus, the potential of the reference potential unit is further reduced. The reference potential of the reference potential unit is further reduced, and thus, the output of the comparator further increases. The output of the comparator increases, and the increased value increases by a value that is obtained by the increase in one board resistor. That is, an output deviation of the comparator increases or decreases according to the number of connected board resistors, and may be a value associated with each board resistor.

According to the embodiment, by changing the output value of the feedback control unit 110 according to a board resistance value based on the number of connected boards, a current that has increased by the increase in board may be further supplied, or a current that has decreased by the decrease in board may be further reduced. That is, the power supply automatically varies the output current of the power source 101, thereby allowing a constant current to flow without change according to the increase or decrease in board.

Figure 6:
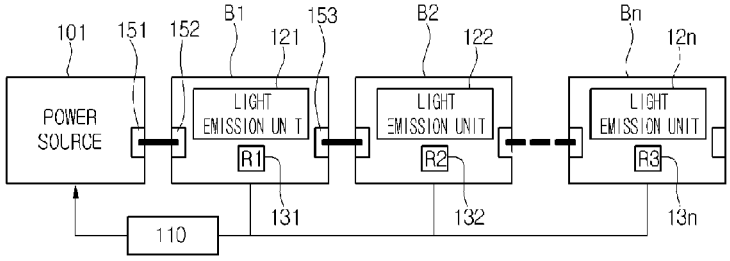
FIG. 6 is a diagram illustrating a connection example of a light emission module according to an embodiment.
Figure 7:
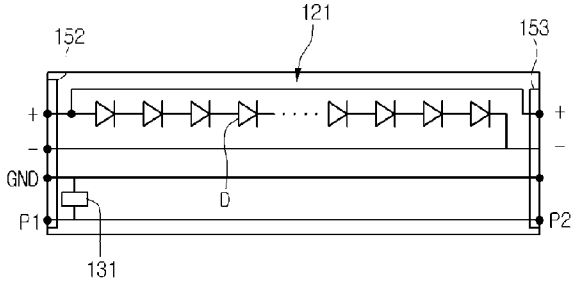
FIG. 7 is a detailed block diagram illustrating a light emission unit and board resistor in one board of FIG. 6.

Referring to FIGS. 6 and 7, a first connector 152 of a first board B1 is connected to a connector 151 of the power source 101, and a positive terminal and negative terminal of the first connector 151 are connected to a second connector 153. A board resistor 131 may be connected in parallel between a ground terminal GND and an inter-connection between a connection port P1 of the first connector 152 and a connection port P2 of the second connector 153. In this way, when the boards B1 to Bn are connected, resistors 131 of respective boards B1 to Bn may be sequentially connected in parallel. In this case, the number of connected boards may be detected with a parallel resistance value of the board resistors 131 to 13*n*. By detecting the number of connected boards B1 to Bn, the output value of the feedback control unit 110 may be changed. Connectors between the boards B1 to Bn may be directly or indirectly connected, but the embodiment is not limited thereto.

The above-described power supply may be applied to a plurality of lighting systems such as backlight units, various kinds of display devices, headlamps, streetlamps, indoor lamps, outdoor lamps, signal lights, and lighting lamps.

According to embodiments, a light emission unit including LEDs and a lighting system such as a light unit including the light emission unit can be improved in reliability.

According to embodiments, a current can be supplied in a constant current scheme, according to the change in the number of light emission units including LEDs or the number of boards.

According to embodiments, the power supply and a lighting system such as a backlight unit including the power supply can be improved in reliability.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A power supply comprising:

a plurality of light emission units connected in parallel, and comprising a plurality of Light Emitting Diodes (LEDs);

a power source supplying a Direct Current (DC) voltage to the light emission units;

a plurality of boards having at least one light emission mounted thereon;

a plurality of board resistors disposed in each of the boards, and electrically connected to each other; and a feedback control unit varying a current supplied from the power source, according to sum of the board resistors which are changed according to the number of connected boards, wherein the feedback control unit comprises:

a resistor connected to a reference voltage;

a reference potential unit outputting a voltage-divided value which is obtained through voltage division by the resistor and the board resistor; and a comparator comparing an output of the reference potential unit and a value of an output terminal in each of the light emission units to output a signal to the power source according to the compared result, thereby controlling an output current of the power source.

2. The power supply according to claim 1, wherein the LEDs of each of the light emission units are serially connected to each other.

3. The power supply according to claim 1, wherein the board resistors are connected to each other in parallel.

4. The power supply according to claim 1, wherein the board resistors of each of the boards are electrically disconnected from the LEDs.

5. The power supply according to claim 1, wherein the feedback control unit comprises a current regulator connected to an output terminal of each of the light emission units and the comparator, other end of the current control unit being connected to the power source.

6. The power supply according to claim 1, wherein each of the boards comprises a connector, the connector connecting the board resistors to each other in parallel.

7. The power supply according to claim 1, wherein a value of each of the board resistors is changed according to the number of connected boards, and the feedback control unit varies a current supplied from the power source, according to the change of the board resistance value.

8. The power supply according to claim 1, wherein the feedback control unit controls a constant current according to the number of connected boards.

9. The power supply according to claim 1, wherein the board resistors have the same resistance value.

10. The power supply according to claim 1, wherein the reference potential unit is connected to one end of the resistor and one end of the board resistor in parallel.

* * * * *